US006328111B1

(12) United States Patent
Bearden et al.

(10) Patent No.: US 6,328,111 B1
(45) Date of Patent: Dec. 11, 2001

(54) LIVE WELL DEPLOYMENT OF ELECTRICAL SUBMERSIBLE PUMP

(75) Inventors: John L. Bearden, Claremore; Kenneth T. Bebak, Tuisa; Earl B. Brookbank, Claremore, all of OK (US); Don C. Cox, Roanoke, TX (US); Ronald S. Fordyce, Aberdeen (GB); David H. Neuroth, Claremore, OK (US); Steven K. Tetzlaff, Huntington Beach, CA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/406,316

(22) Filed: Sep. 27, 1999

Related U.S. Application Data

(60) Provisional application No. 60/121,455, filed on Feb. 24, 1999.

(51) Int. Cl.[7] ..... E21B 23/00

(52) U.S. Cl. ..... 166/381; 166/106

(58) Field of Search ..... 166/106, 180, 166/188, 192, 381, 386, 387

(56) References Cited

U.S. PATENT DOCUMENTS

| | | | |
|---|---|---|---|
| 3,672,795 | 6/1972 | Arutunoff et al. . | |
| 3,965,987 | 6/1976 | Biffle | 166/315 |
| 4,003,428 | 1/1977 | Zehren . | |
| 4,171,934 | 10/1979 | Zehren . | |
| 4,331,203 | 5/1982 | Kiefer . | |
| 4,352,394 | 10/1982 | Zehren . | |
| 4,391,330 | 7/1983 | Kiefer . | |
| 4,425,965 | 1/1984 | Bayh, III et al. . | |
| 4,440,221 | 4/1984 | Taylor et al. . | |
| 4,473,122 | 9/1984 | Tamplen | 166/373 |

FOREIGN PATENT DOCUMENTS

| | | | |
|---|---|---|---|
| 2320269A | 6/1998 | (GB) | 33/68 |
| 2326892A | 1/1999 | (GB) | 33/68 |

OTHER PUBLICATIONS

HWC Offshore Snubbing Unit; product discription; undated.

Thru–Tubing Retrievable Packer Product No. 330–01; product information; Baker Hughes; Mar. 1996.

CT ESP for Yme, Converting the Yme Field Offshore Norway from a Conventional Rig–Operated Field to CT–Operated for Workover and drilling Applications; A. Baklid, O.J. Apeland, A.S. Teigen, Statoil; SPE 46018; 1998.

Advances in Electro Coiled Tubing Deployed ESP Systems; D.H.Neuroth, E.B.Brookbank; 1998.

South China sea gas lifted oil well conversion utilizing coil tubing Electric Submersible Pumping Systems; G.Pastor, R.Knoppe; 1999.

(List continued on next page.)

*Primary Examiner*—David Bagnell
*Assistant Examiner*—Jennifer Dougherty
(74) *Attorney, Agent, or Firm*—Bracewell & Patterson, L.L.P.

(57) ABSTRACT

A method for installing a submersible pump assembly that allows deployment in a live well under pressure. In some of the embodiments, a pressure barrier is installed in the well lower than a length of the submersible pump assembly. The submersible pump assembly is lowered on a line into the chamber, then a lubricator at the surface seals around the line by allowing the pressure barrier to be released and the submersible pump assembly to be lowered into the well to a desired depth. Preferably, there is a lower pressure barrier in the well. The upper pressure barrier may be a packer that may be collapsed and retrieved alongside the submersible pump assembly. The pressure barrier also may be a packer that is temporarily set in the well, then engaged by the submersible pump assembly, with the pump assembly and packer then being lowered as a unit to a further depth in the well.

45 Claims, 9 Drawing Sheets

U.S. PATENT DOCUMENTS

| | | | | |
|---|---|---|---|---|
| 4,529,035 | | 7/1985 | Bayh, III . | |
| 4,621,689 | * | 11/1986 | Brookbank | 166/106 |
| 4,625,798 | | 12/1986 | Bayh, III . | |
| 4,844,166 | | 7/1989 | Going, III | 166/379 |
| 5,529,127 | | 6/1996 | Burleson et al. . | |
| 5,568,837 | | 10/1996 | Funk | 166/383 |
| 6,050,340 | * | 4/2000 | Scott | 166/373 |
| 6,138,765 | * | 10/2000 | Russell et al. | 166/387 |

* cited by examiner

LIVE WELL DEPLOYMENT OF ELECTRICAL SUBMERSIBLE PUMP

CROSS-REFERENCE

This application claims the benefits of provisional patent application Ser. No. 60/121,455, filed Feb. 24, 1999.

TECHNICAL FIELD

This invention relates in general to installing an electrical submersible pump assembly in a live well that may contain pressure and in particular to methods for installing an ESP in a way to maintain at least two pressure barriers while at all times personnel are located at the well.

BACKGROUND ART

Electrical submersible pumps are commonly used in oil and gas wells for producing large volumes of well fluid. An electrical submersible pump (hereinafter referred to "ESP") normally has a centrifugal pump with a large number of stages of impellers and diffusers. The pump is driven by a downhole motor, which is a large three-phase AC motor. A seal section separates the motor from the pump for equalizing internal pressure of lubricant within the motor to that of the well bore. Often, additional components will be included, such as a gas separator, a sand separator and a pressure and temperature measuring module. Large ESP assemblies may exceed 100 feet in length.

An ESP is normally installed by securing it to a string of production tubing and lowering the ESP assembly into the well. Production tubing is made up of sections of pipe, each being about 30 feet in length. The well will be dead, that is not be capable of flowing under its own pressure, while the pump and tubing are lowered into the well. To prevent the possibility of a blowout, a kill fluid may be loaded in the well, the kill fluid having a weight that provides a hydrostatic pressure significantly greater than that of the formation pressure. During operation, the pump draws from well fluid in the casing and discharges it up through the production tubing.

While kill fluid provides safety, it can damage the formation by encroaching into the formation. Sometimes it is difficult to achieve desired flow from the earth formation after kill fluid has been employed. The kill fluid adds expense to a workover and must be disposed of afterward. ESPs have to be retrieved periodically, generally around every 18 months, to repair or replace the components of the ESP. It would be advantageous to avoid using a kill fluid. However, in wells that are live, that is wells that contain enough pressure to flow or potentially have pressure at the surface, there is no satisfactory way to retrieve an ESP and reinstall an ESP on conventional production tubing.

Coiled tubing has been used for a number of years for deploying various tools in wells, including wells that are live. A pressure controller, often referred to as a stripper or blowout preventer, is mounted at the upper end of the well to seal around the coiled tubing while the coiled tubing is moving into or out of the well. The coiled tubing comprises steel tubing that wraps around a large reel. An injector grips the coiled tubing and forces it from the reel into the well.

The preferred coiled tubing for an ESP has the power cable inserted through the coiled tubing. Various systems are employed to support the power cable to the coiled tubing to avoid the power cable parting of its own weight. Some of the systems utilize anchors that engage the coiled tubing and are spaced along the length of the coiled tubing. Another uses a liquid to provide buoyancy to the cable within the coiled tubing. In the coiled tubing deployed systems, the pump discharges into a liner or in casing. A packer separates the intake of the pump from the discharge into the casing. Although there are some patents and technical literature dealing with deploying ESPs on coiled tubing, only a few installations have been done to date. To applicant's knowledge, none of these installations involve deploying an ESP on coiled tubing into a live well.

While deploying tools within a live well, safety rules require that while workers are nearby, there must be two independent pressure barriers to prevent a blowout. It is known in the prior art to install a packer downhole then land a stinger portion of an ESP in the bore of the packer. There is also prior art that suggests that a safety valve may be incorporated with the packer to provide a first safety barrier.

The second pressure barrier has been proposed in the prior art to be located at the surface. Blowout preventers (BOP) are well known that will seal on cylindrical members and still allow downward movement of that cylindrical member. Some types have an annular element that is deformed into sealing engagement with whatever cylindrical member is located therein, regardless of the diameter. Ram-types have two separate members, each with a semi-cylindrical concave inner profile, that are forced against a cylindrical object of a predetermined diameter. However, ESP assemblies are made up of connections between the various components that present discontinuities in the cylindrical configurations of the components. The connections typically are flanged and have smaller outer diameters than the components. A BOP would not be able to seal on a connection as it is lowered past because of the discontinuity. Positioning the ESP assembly in an isolation chamber below a coiled tubing lubricator and above a BOP on the wellhead would allow an upper pressure barrier to be maintained at all times. However, the length of the ESP assembly in many cases makes this solution impractical.

Snubbers are used for lowering tools into a well, particularly where a draw works is not available. A snubber mounts on top of a BOP and has hydraulic rams to raise and lower a set of tubing slips. A lower second set of slips holds the equipment while the top slips get another "bite". Snubbers may be used to pull equipment from a well or force the equipment into the well, sometimes through deviations or collapsed sections of casing. Snubbers have occasionally been used to install and retrieve ESP assemblies, but not with any live wells.

Technical literature has discussed deploying an ESP and coiled tubing in a live well. However, the literature does not address all of the concerns mentioned above concerning maintaining two pressure barriers at all times.

SUMMARY OF THE INVENTION

This invention provides several methods for installing a submersible pump assembly in a live well. In some of the methods, an upper pressure barrier is installed in the well at a depth lower than a length of the submersible pump assembly. The upper pressure barrier defines a chamber in the well that is isolated from any pressure in the well below. This allows the ESP to be safely lowered on a line into the chamber because the chamber will not contain pressure. Once in the chamber, the operator seals around the line, releases the upper pressure barrier and lowers the ESP into the well to a desired depth. The upper pressure barrier mentioned maintains one barrier until it is released, then the coiled tubing lubricator serves as the upper pressure barrier.

A lower pressure barrier may be maintained at all times by installing a packer with a valve in the well prior to installing the upper pressure barrier.

In one embodiment, the upper pressure barrier is lowered in a collapsed configuration that is significantly smaller than its expanded or set diameter. After the submersible pump assembly is located in the chamber and the line sealed by the lubricator, the pressure barrier is collapsed and withdrawn along a path that is lateral of the submersible pump assembly. In one of the variations of this embodiment, the upper pressure barrier is a packer that is lowered on a string of coiled tubing through an annulus between a casing and a liner. In another variation, the upper barrier is lowered in a collapsed configuration through a string of tubing located off center in the well. The packer passes below the laterally deployed tubing and sets in the casing below the tubing. The upper pressure barrier is retrieved through the laterally disposed tubing.

In another embodiment, the upper pressure barrier comprises an upper packer that has a throughbore containing a valve and an open upper end. The upper packer is set in the casing or in a liner at a depth greater than the length of the ESP assembly. While the valve is closed, the ESP assembly is lowered into the well and latched into the bore of the upper packer. Then, the upper packer is released and the upper packer and the submersible pump assembly are lowered together as a unit to the desired depth. In the preferred embodiment, the unit stabs into a lower packer that has been previously installed and opens a downhole safety valve in the lower packer.

In another embodiment, the upper pressure barrier is installed by lowering a flow conduit in the well, the flow conduit being large enough in diameter to accept the ESP and having an upper valve that blocks flow through the flow conduit. The upper valve is located a distance below the upper end of the well that is greater than a length of the ESP assembly. The ESP is lowered into the flow conduit while the upper valve is closed. Once fully in the flow conduit, a stripper or blowout preventer may be engaged to seal against the coiled tubing that is lowering the ESP into the well. The ESP is then lowered into engagement with a lower previously set packer and the lower valve opened.

In still another embodiment, a pressure control system is mounted to the upper end of the well that has upper and lower seals that will seal on components of the ESP while simultaneously allowing downward sliding movement of the components. A tubular chamber extends between the seals, the chamber having a length less than an overall length of the ESP. The ESP is fitted with a valve in the assembly that may be closed to prevent flow through the flow path of the pump. The ESP is lowered into the chamber with the lower end of the chamber blocked from the well by an access valve. The ESP passes through the upper and lower seals, with the valve preventing upward flow through the pump. The length of the chamber is selected so that when one of the connections between the components of the ESP is adjacent the lower seal, the upper seal will be in sealingly engagement with one of the components. One of the seals will thus always be in sealing engagement with the pump assembly.

BEST MODE FOR CARRYING OUT THE INVENTION

Figure 1:
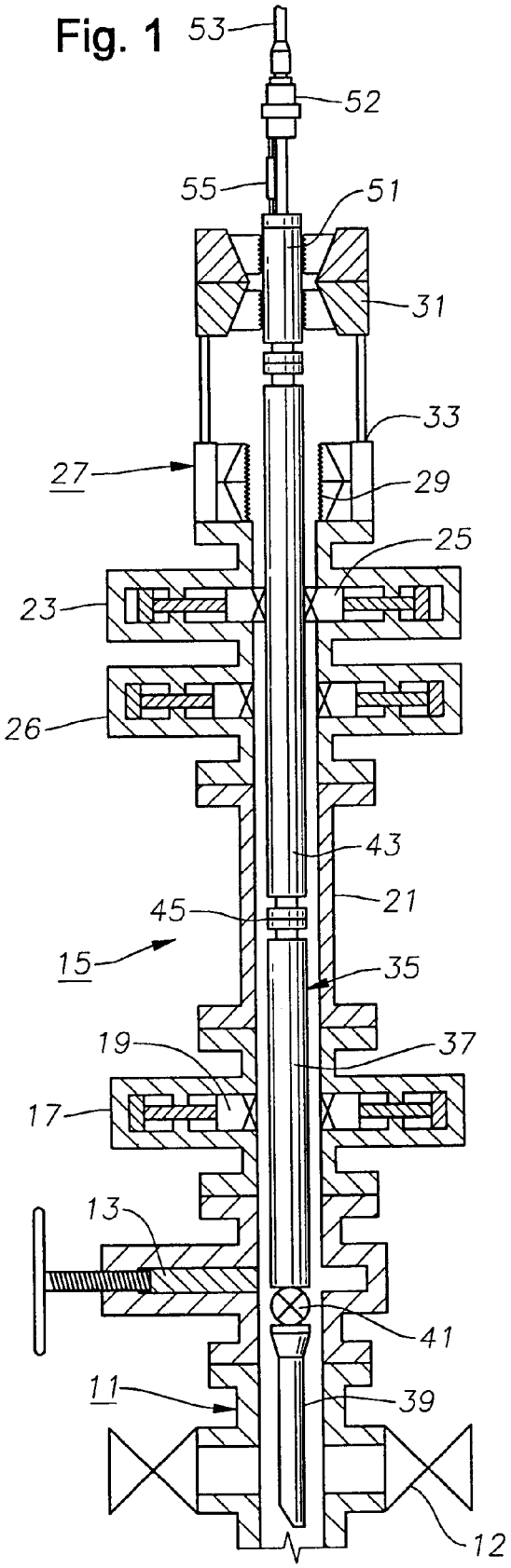
FIG. 1 is a schematic view representing one embodiment of a method for employing an ESP in a live well.

Referring to FIG. 1, a wellhead 11 is shown schematically. Wellhead 11 has a number of valves 12 for controlling production from the well. Wellhead 11 also will have an access valve 13, often called a swab valve, that controls axial access to the well. Alternately, access valve 13 could be mounted on top of wellhead 11. A snubber assembly 15 is mounted to the upper end of wellhead 11. Snubber assembly 15 includes a lower seal or BOP 17 of conventional design. BOP 17 is a pressure controller that may be of an annular type, which has an annular elastomeric element 19. A piston deforms annular elastomeric element 19 inward into an sealing engagement with tubular members of a variety of diameters. Alternately, BOP 17 may be a ram type, which has two sealing members that have semi-cylindrical concave faces that seal tightly against a tubular member of a selected diameter. Further, if the anticipated pressures are not very high, BOP 17 could be of a passive type, such as a drill pipe stripper that comprises an elastomeric seal member with a hole though it of smaller diameter than the drill pipe to cause sealing. The latter type does not have open and closed positions.

A spool 21 mounts to the upper end of lower BOP 17. Spool 21 is a tubular member with a connection on its lower end for connecting to lower BOP 17 and a connection on its upper end for connecting to an upper BOP 23. Upper BOP 23 may be identical to lower BOP 17. It also has a packer element 25 that may comprise rams or an annular member. Below upper BOP 23 is a ram type BOP 26 fitted with slips suitable for gripping and holding an ESP assembly and preventing axial movement.

Initially, a gripping assembly 27 will be mounted to the top of upper BOP 23. Gripping assembly 27 has a set of stationary slips 29, which when engaged will grip tubular objects and prevent axial movement either downward or upward. Gripping assembly 27 also has a set of traveling slips 31. Traveling slips 31 move up and down relative to stationary slip 29. Traveling slips 31 also will grip a tubular member to prevent upward or downward movement relative to traveling slips 31. Hydraulic cylinders 33 extend from stationary slips 29 to traveling slips 31 to stroke traveling slips 31 up and down. The amount of stroke may be several feet.

An ESP assembly 35 is shown being lowered into wellhead 11. ESP 35 includes a pump 37, which is shown on the lower end of the assembly but alternately could be on the upper end of the assembly. Pump 37 is preferably a centrifugal pump having a large number of impeller and diffuser stages. Other types of pumps may also be employed. A stinger or tailpipe 39 extends downward from pump 37 for intake of well fluid. Pump 37 is conventional, having a flow path through its stages, the flow path leading from an intake to an outlet. In this instance, the intake is in communication with tailpipe 39. Pump assembly 37 is fitted with a valve 41 that will selectively block upward flow along the flow path 37. Valve 41 may be opened and closed hydraulically or electrically. Alternately, it may be of a type that opens due to the pressure to the pump operating.

A seal section 43 joins the upper end of pump 37 in this embodiment. Seal section 43 is connected to pump 37 by a connector 45, and motor 47 is connected to seal section 43 by a similar connector 45. Seal section 43 is conventional, having the ability to equalize internal pressure of lubricant within motor 47 with hydrostatic well fluid pressure. Normally this involves the use of bladders that have one side exposed to well fluid pressure and the other side exposed to lubricant. Motor 47 is conventional, preferably being a three-phase electrical motor. Other types of prime movers may be used in place of electrical motor 47, such as a hydraulically driven motor. An adapter 51 connects to the upper end of motor 47 by a similar connector 45. Adapter 51 secures to a head 52 by another connector 45, which in turn secures to a line that has the capability of supporting the weight of ESP 35 as well as supplying power. In the preferred embodiment, the line is preferably a string of coiled tubing 53 that contains an electrical power cable 55. Power cable 55 extends through the interior of coiled tubing 53, through adapter 51 and into engagement with motor 47. Anchors (not shown) or other devices will be attached to power cable 55 for engaging the inner wall of coiled tubing 53 to support the weight of power cable 55 within coiled tubing 53. The connectors 45 may be of various types, but are shown to be of a conventional type in which flanges are bolted together. The flanges are part of short spool members that in turn are secured to the ends of components 37, 43, 47 and 51. Connectors 45 have portions that have diameters smaller than the diameters of the components 37, 43, 47 and 51, resulting in discontinuities in the overall cylindrical exterior of ESP assembly 35.

Snubber assembly 15 will be mounted to wellhead 11 while access valve 13 is closed. Access valve 13 will at this time provide an upper pressure barrier. The well may be live and, thus, may contain pressure. However, there also may be a lower barrier set in the well to serve as a primary pressure barrier. The length of spool 21 will normally not be long enough to receive within it the entire submersible pump assembly from tailpipe 39 to head 52. Typically, it will be much shorter so that the upper end of snubber assembly 15 is readily available to workers. The length of spool 21 is selected so that at all times one of the BOPs 17, 23 will be able to seal on one of the ESP components 37, 43, 47 or 51. When one of the connectors 45 approaches one of the BOPs 17, 23, that BOP will be opened while the other BOP remains closed. For example, in FIG. 1, the lowermost connector 45 will reach lower BOP 17 before the uppermost connector 45 will reach upper BOP 23. Consequently, element 25 of upper BOP 23 is closed against the cylindrical exterior of motor 47 and element 19 of BOP 17 is open. This allows any pressure in the well to exist inside spool 21. Once the lowermost connector 45 has moved downward past lower BOP 17, the packer element 19 of lower BOP 17 may be closed against the cylindrical exterior of seal section 43. This allows the upper packer element 25 to be open for the passage of the uppermost connector 45. In some cases, it may be necessary to have more than one spool 21 and more than two BOPs so as to be assured that at no point will connectors 45 appear simultaneously at both of BOPs 17, 23. If passive stripper rubbers are used as BOPs 17, 23, they are not opened and closed. However, while a connector 45 passes through, they will not form a seal on the connector.

Figure 2:
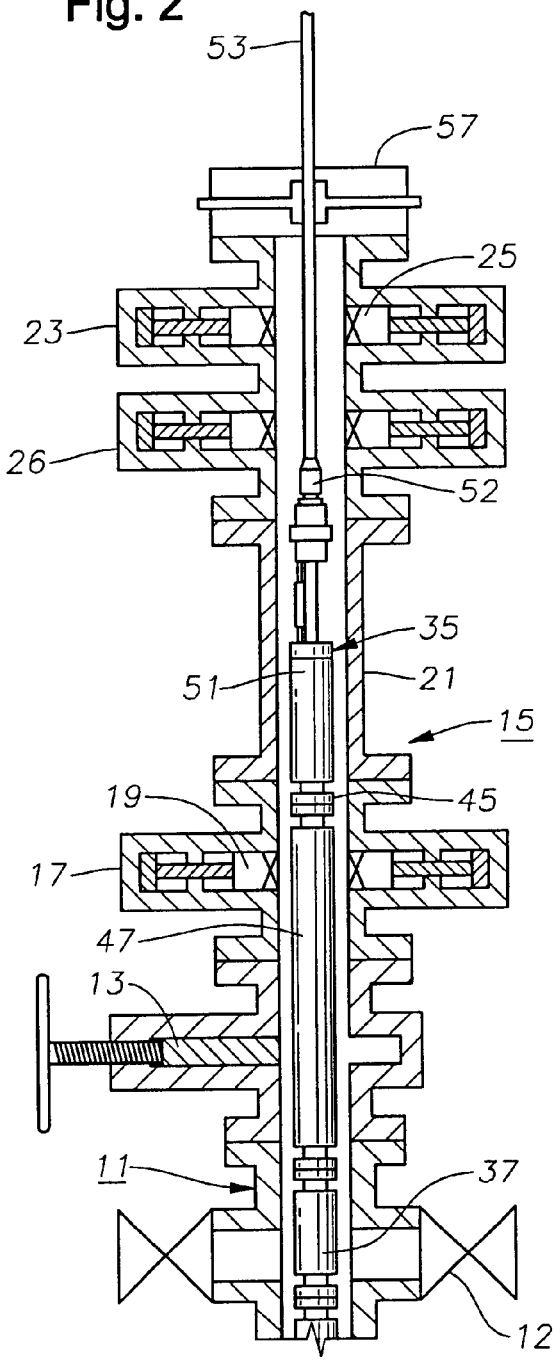
FIG. 2 is a view illustrating the method of FIG. 1, but shown after the ESP has been lowered below an upper seal.

In the operation of the embodiment of FIGS. 1 and 2, initially access valve 13 is closed while ESP 35 is lowered to a point where tailpipe 13 is just above access valve 13. Both BOPs 17, 23, would normally be open at this point. Then, one of the BOPs 17, 23 will be closed, while the other will remain open. The one remaining open will be the one that is closest to one of the connectors 45. In this instance, the lower BOP 17 is open. The packer element 25 of upper BOP 23 is closed against the housing of motor 47. Any pressure that exists in spool 21 will be contained by the sealing action of packer element 25. Traveling slips 31 will grip one of the components and begin pushing the ESP 35 downward. In this instance, traveling slips 31 are gripping adapter 51. The downward movement is resisted by the frictional engagement of packer element 25 and also by any pressure that may exist in spool 21. Once gripping element reaches the lower end of its stroke, stationary slips 29 will grip one of the components of ESP 35 to hold it against any upward or downward movement while traveling slips 31 are retracted and moved back to an upper position. Then the stationary slips 29 will be released and the process repeated.

As mentioned above, when one of the flange connectors 45 nears one of the BOPs 17, 23, the other BOP will be closed and the one in proximity will be opened. Valve 41 prevents any fluid within the well from flowing up through the pump 37 while packer element 19 is closed around the cylindrical housing of pump 37.

Once the upper end of ESP assembly 35 is below upper BOP 23, upper packer element 25 will be closed on coiled tubing 53. Packer element 25 is preferably of an annular type that will seal on coiled tubing 52 as well as on larger diameter components 37, 43, 47 and 51 of ESP 35. Then, gripping assembly 27 will be removed while ram-type BOP 26 grips and holds ESP 35. A coil tubing injector assembly 57 (schematically shown), consisting of the injector, a coil tubing stripper, one or more coil tubing BOP's and a spool of suitable length (2 to 10 feet) is made up. Injector assembly 57, along with coil tubing 52 and attached ESP 35, are lowered and secured to the top of BOP 23, after which the injector runs the coil tubing 52 and ESP 35 into the well. The coil tubing stripper of coil tubing injector assembly 57 is the primary seal and the coil tubing BOP's are backups. Additionally we need to show a ram type BOP, fitted with slips to grip an hold the ESP assembly, just blow BOP 23. If a packer (not shown) has been previously installed in the well, tailpipe 39 will stab into the packer, and the packer will locate between the inlet and outlet of pump 37. At that point, injector assembly 57 may be removed and coiled tubing 53 suspended by a conventional coiled tubing hanger (not shown) within wellhead 11.

Figure 3:
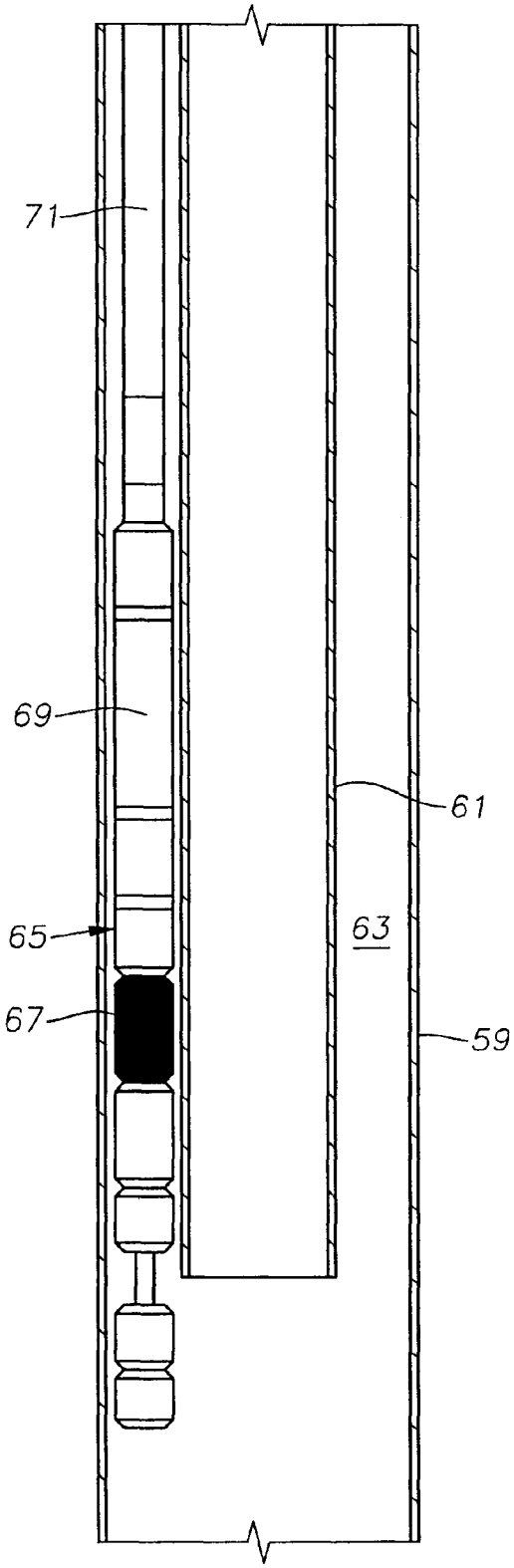
FIG. 3 is a schematic sectional view of a portion of a well illustrating another method according to the invention.
Figure 4A:
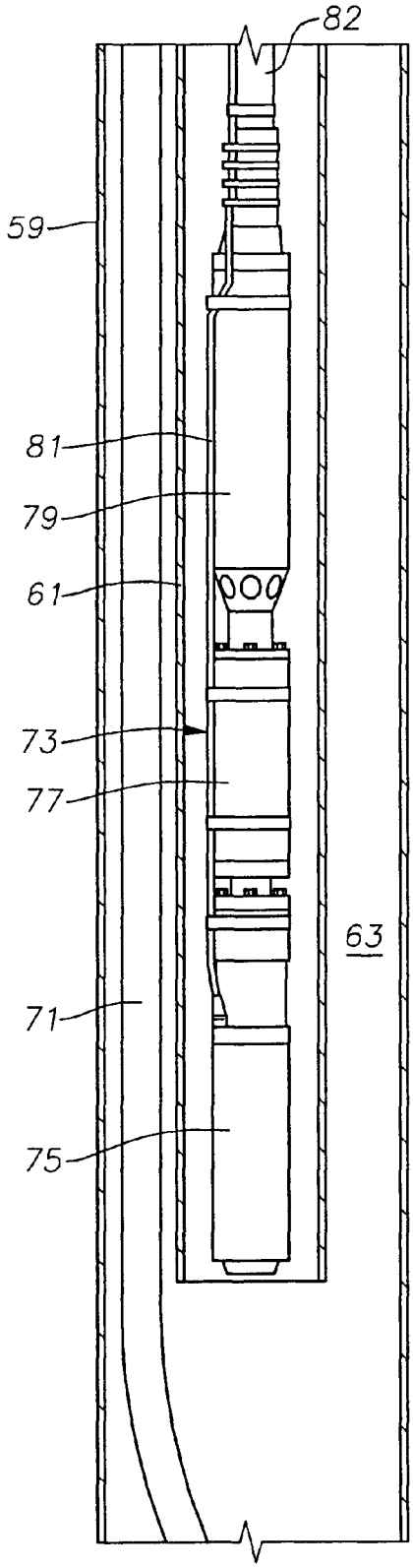
FIGS. 4A and 4B are a section view like FIG. 3, but showing the packer in a set position.
Figure 4B:
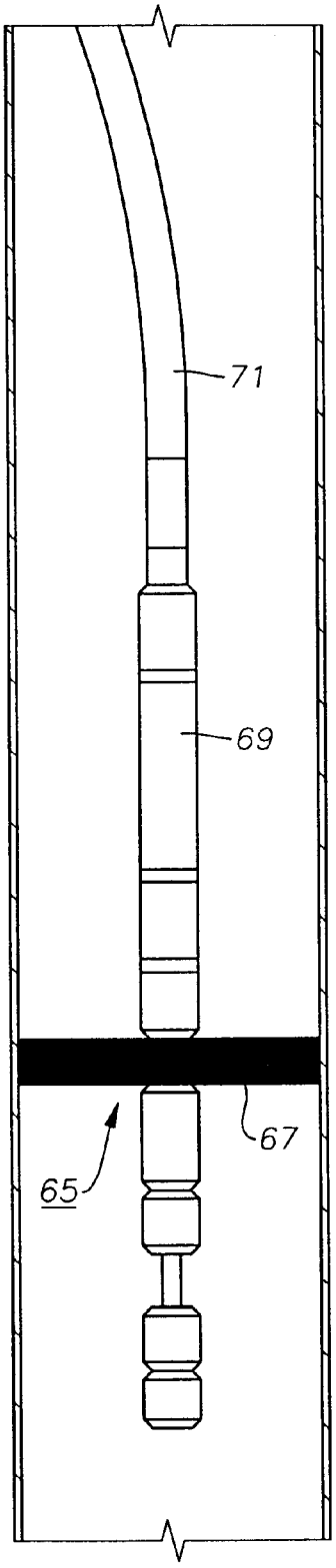

Referring to FIG. 3, an alternate embodiment is shown. In the first embodiment of FIGS. 1 and 2, snubber assembly 15 provides an isolation chamber for isolating portions of the ESP assembly 35 from any well pressure while the ESP assembly is lowered into the well. In the embodiment of FIGS. 3 and 4A, 4B, the isolation chamber for the ESP assembly is provided within the well, rather than above the wellhead. The well has casing 59 that is considered live in that it may contain pressure. A liner 61 is installed in casing 59 to a depth that need be only long enough to accommodate the length of an ESP assembly. Liner 61 is a tubular member of a diameter sufficient to accommodate an ESP assembly. Preferably it comprises two or three sections of casing that have flush joints so that it may be lowered through a type of lubricator such as lubricator 57 shown in FIG. 1 if the well is live. Also, since the length of liner 61 is not very great, a workover unit will not be needed to lower liner 61 into the well. An annulus 63 exists between liner 61 and casing 59. A lower pressure barrier such as a packer with a downhole safety valve (not shown) is preferably employed to block the upper portion of casing 59 from pressure.

An upper pressure barrier comprising a packer 65 is shown being lowered through annulus 63. The term "packer" as used herein means any type of plug or closure member that will seal within a bore and that has the necessary passages or ports through it for accomplishing its function. Packer 65 is a small outer diameter tool that has a packer element 67 that is capable of expanding several times its initial diameter. Packers of this nature are commercially available. In the collapsed configuration, packer 65 is able to be lowered through annulus 63. FIGS. 3, 4A, 4B, 5 and 6 are not to scale, rather exaggerate the amount of expansion of packer 65. In the expanded condition shown in FIG. 4B, packer 65 has expanded element 67 sufficiently to seal against casing 59. Packer 65 is shown only schematically and will have a running tool 69 that connects it to a line 71, preferably a string of coiled tubing. A lubricator, such as lubricator 57 (FIG. 2), is employed at the upper end of the wellhead (not shown) to seal around coiled tubing 71 while packer 65 is being lowered into the well by a coiled tubing injector (not shown). The coiled tubing injector will position packer 65 at a point below the open lower end of liner 61. Then, it will be set. One manner of setting packer 65 is by pumping a ball down coiled tubing 71, which contacts a seat and actuates packer 65 to move to the expanded condition shown schematically in FIG. 4B. Preferably, the bore through packer 65 will be closed when packer 65 is in the set position so as to block any pressure from below packer element 67 to the interior of coiled tubing 71. Thus, although referred to as a "packer", packer 65 serves as a bridge plug once set. Although coiled tubing 71 could be released once packer element 67 is set, preferably it remains connected as shown in FIG. 4B so as to avoid having to stab back into engagement with packer 65.

A conventional ESP assembly 73 is lowered into liner 61. The lower end of ESP assembly 73 will be located above the upper end of liner 61 when ESP assembly 73 is fully located within liner 61. ESP assembly 73 may be made up inverted as shown in FIG. 1 or it may be as shown in FIG. 4A, having a motor 75 on bottom. Motor 75 is connected to a conventional seal section 77, which in turn connects on the upper end to a pump 79. A motor lead 81 extends from a power cable within coiled tubing 82 down to motor 75. Coiled tubing 82 is a different string of coiled tubing than coiled tubing 71. ESP assembly 73 does not need to be passed through a lubricator such as lubricator 57 because of the existence of the packer 65 in the set position shown in FIG. 4B.

In the operation of the embodiment of FIGS. 3 and 4A, 4B, first liner 61 will be installed. Then packer 65 will be lowered on coiled tubing 71 through annulus 63, using a lubricator such as lubricator 57 if the well has already been perforated. Packer 65 will be set, expanding packer element 67 to the expanded condition of FIG. 4B. Then, ESP assembly 73 is lowered on coiled tubing 82 into liner 61. Then, the lubricator will be sealed around coiled tubing 82. Packer 65 will be released by pulling coiled tubing 71 upward, which causes packer element 67 to move to the contracted condition. Packer 65 will be pulled up alongside ESP assembly 73 and preferably retrieved to the surface. While retrieving packer 65 to the surface, the lubricator must seal on coiled tubing 71 while continuing to maintain a seal on coiled tubing 82. The lubricator preferably has two bores, each of which has a separate grease injection port for sealing around a string of coiled tubing. Once packer element 67 has been released and pulled above the lower end of liner 61, the coiled tubing injector pushes coiled tubing 82 downward to lower pump ESP assembly 73 to the desired depth.

Figure 5:
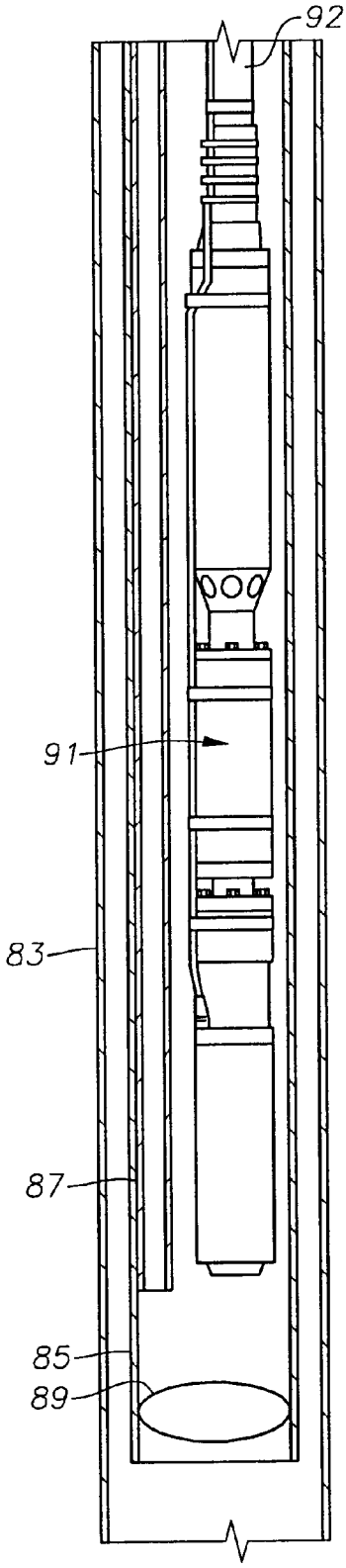
FIG. 5 is a sectional view schematically illustrating another embodiment, this embodiment being a variation of FIG. 3.

FIG. 5 shows a variation of the embodiment of FIGS. 3 and 4A, 4B. In this embodiment, casing 83 will be considered live in that it may be subjected to pressure. As in the other embodiment, however, there could be a previously set packer and safety valve to form a lower barrier. Again, a liner 85 will be deployed in casing 83. In this embodiment, a length of coiled tubing 87 will be located off center of the axis of liner 85, but within liner 85. A packer 89, shown schematically in FIG. 5 and constructed generally as packer 65, will be lowered through coiled tubing 87 and set below coiled tubing 87, but within liner 61. ESP 91 is conventional. Packer 89 will be lowered on a line that may also be coiled tubing.

In the operation of the embodiment of FIG. 5, coiled tubing 87 may be installed in liner 85 at the surface or installed after liner 85 is located in the well. Packer 89 is lowered through tubing 87 and moved to the expanded position within liner 85 to form an upper pressure barrier. ESP 91 is then lowered into liner 85. The length of liner 85 will not be much greater than the length of ESP 91. After a lubricator, such as lubricator 57 (FIG. 2), has sealed on coiled tubing 92, packer 89 is retrieved through coiled tubing 87. Then, ESP assembly 91 may be lowered to the desired depth with the lubricator sealing against coiled tubing 92.

Figure 6:
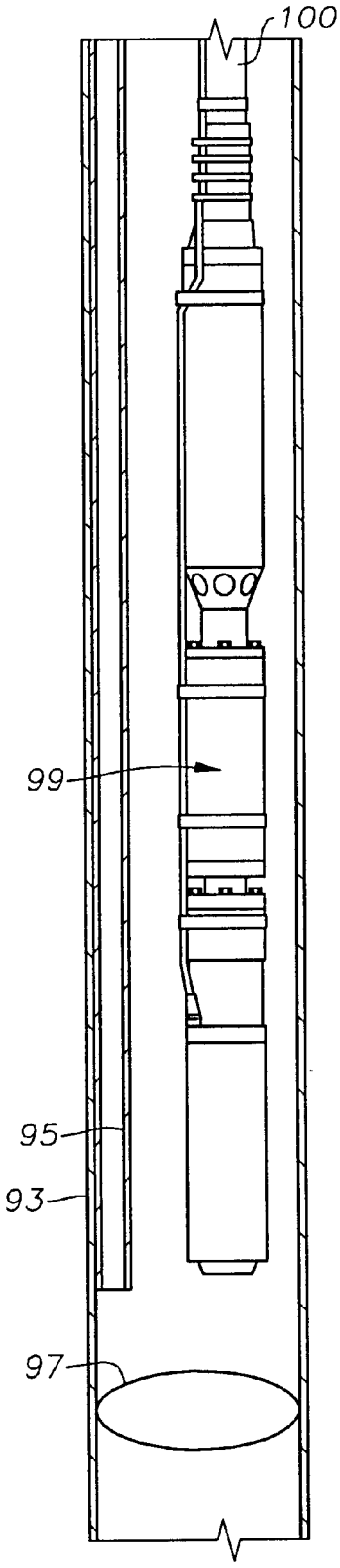
FIG. 6 is another schematic sectional view illustrating still another variation of the embodiment of FIG. 3.
Figure 7:
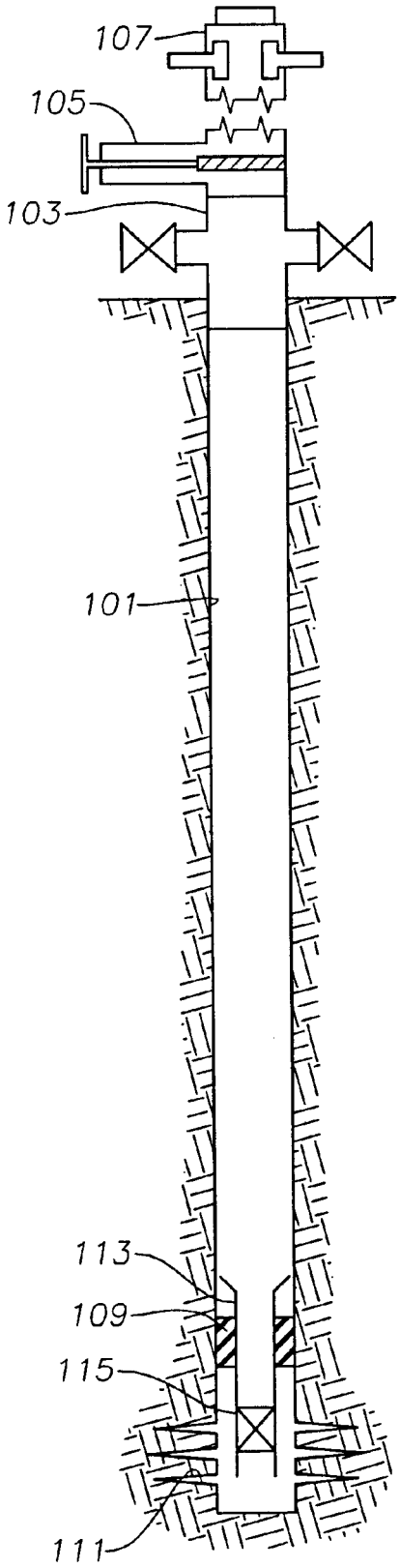
FIG. 7 is a schematic view of a well illustrating another embodiment of this invention, showing an initial step.

FIG. 6 illustrates still another variation of the embodiment of FIG. 3. In FIG. 6, casing 93 is considered live. A length of coiled tubing 95 will be lowered alongside ESP assembly 99. The length of coiled tubing 95 will be only slightly greater than the length of ESP assembly 99. Packer 97 is secured to its own length of coiled tubing (not shown) and deployed through tubing 95. Packer 97 will set in casing 93. This forms an upper pressure barrier that allows ESP assembly 99 to be lowered into casing 93 on coiled tubing 100. Once at the desired depth, a lubricator, such as lubricator 57 (FIG. 2), will close on coiled tubing 100. Then, packer 97 is released and retrieved through tubing 95.

FIGS. 7–12 illustrate another embodiment of the invention. The well has casing 101 and a wellhead 103 at the upper end. Wellhead 103 has an access valve 105 that controls axial access to casing 101. A lubricator 107 will be installed above access valve 105. A lower packer 109 is shown set in casing 101. Lower packer 109 is conventional and is set just above perforations 111 in casing 101. Lower packer 109 has a throughbore 113 with a valve 115 located in throughbore 113 for blocking flow upward throughbore 113. Packer 109 is cylindrical in configuration and constructed generally as packer 65 shown in FIG. 3. It is deployed in casing 101 while under live conditions by the use of lubricator 107. The distance between the lubricator 107 and access valve 105 is sufficient to accommodate the length of the lower packer 109. Packer 109 is preferably deployed on a line such as coiled tubing. Lubricator 107 will seal on the coiled tubing before access valve 105 is open. Then, lubricator 107 seals while the coiled tubing injector moves packer 109 downward and sets it in a position shown in FIG. 7. The coiled tubing is then retrieved.

Figure 8:
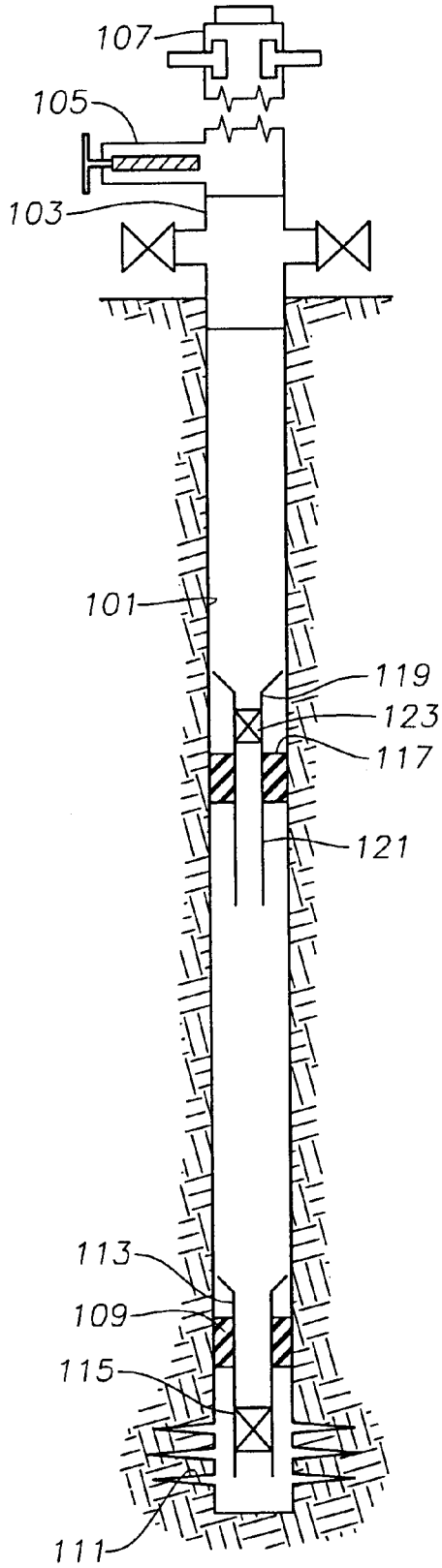
FIG. 8 is a view of the well of FIG. 7, showing a second step.

Then, an upper packer 117 is set in casing 101 as shown in FIG. 8. Upper packer 117 is also conventional. It has a throughbore 119, a stinger 121 on its lower end and a valve 123. Stinger 121 is adapted to slide sealingly into bore 113 of lower packer 109. Upper packer 117 is also deployed on a string of coiled tubing, using lubricator 107 in the same manner as in connection with lower packer 109. Valves 115 and 123 provide two separate and independent pressure barriers.

Figure 9:
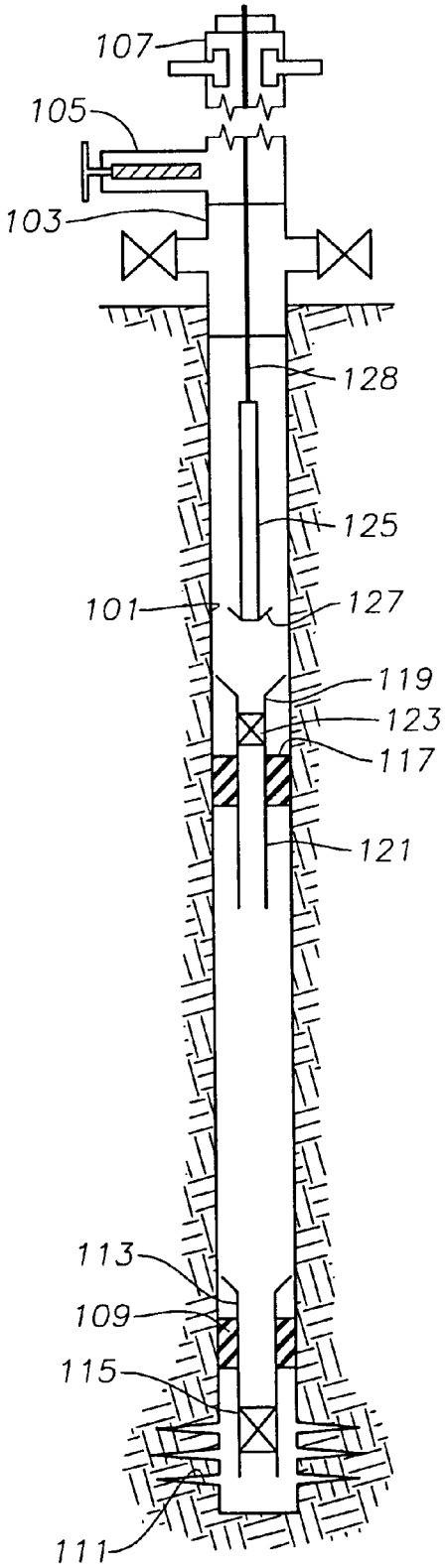
FIG. 9 is a schematic view of the well of FIG. 7, showing a third step.
Figure 10:
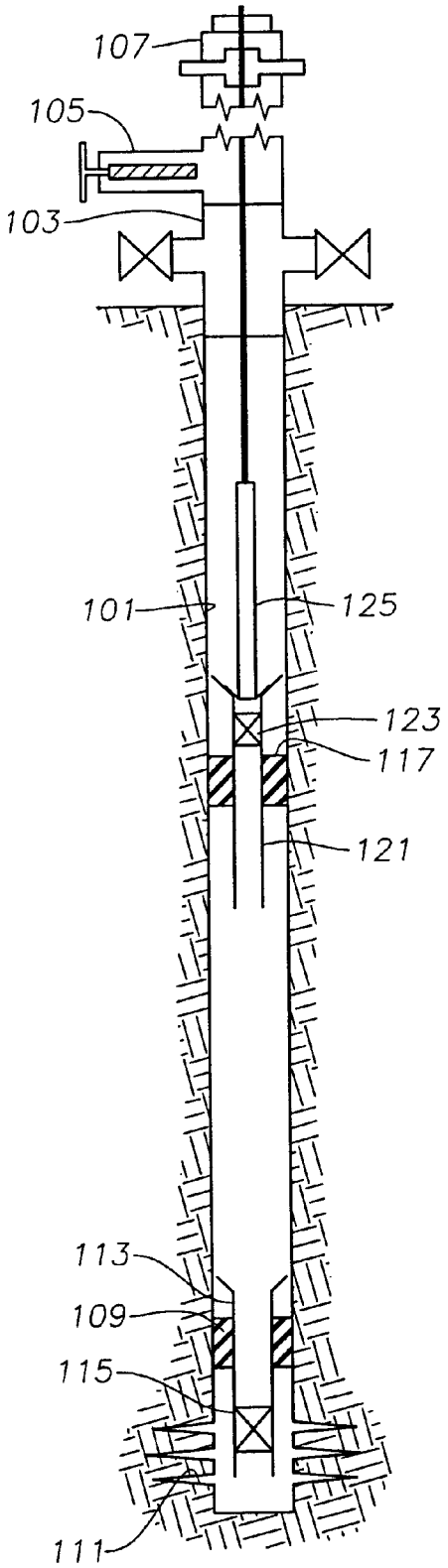
FIG. 10 is a schematic view of the well of FIG. 7, showing another step.

Valve 123 provides an isolation chamber above upper packer 117. Upper packer 117 needs only to be set to a depth greater than the length of ESP assembly 125 as shown in FIG. 9. ESP assembly 125 is conventional except for having a latch 127 on its lower end. Latch 127 adapted to latch into the polished bore 119 of upper packer 117. ESP assembly 125 is also lowered on a coiled tubing string 128. Once latch 127 has engaged packer 117, an upward pull on coiled tubing 128 will release packer 117. FIG. 10 shows ESP assembly 125 in engagement with upper packer 117 while in a released position. Lubricator 107 will be in sealing engagement with coiled tubing 128, serving as the upper pressure barrier. The lower pressure barrier will still be handled by lower packer 109. Valve 123 may be open at this point or it may be opened later by several methods. Valve 123 could be of a type, such as a flapper valve, that opens automatically due to mechanical engagement with ESP 125 in bore 119 of packer 117. Valve 123 could be opened by pump pressure. Alternately, valve 123 could be opened and closed by electrical signals transmitted through the power cable extending through coiled tubing 128. Also, hydraulic pressure supplied from the surface down coiled tubing 128 within an annulus surrounding the power cable could actuate valve 123.

Figure 11:
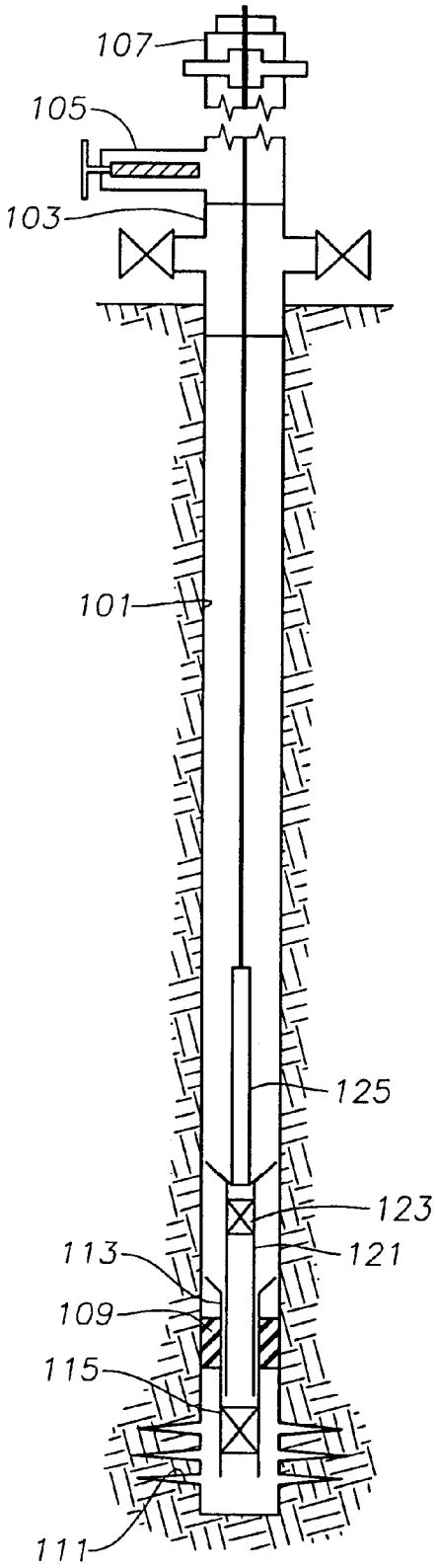
FIG. 11 is a schematic view of the well of FIG. 7, showing still another step.

Referring to FIG. 11, upper packer 117 and ESP assembly 125 now can move downward as a unit while lubricator 107 continues to seal against coiled tubing 128. Stinger 121 stabs and seals into the polished bore of packer 109 as shown in FIG. 11. Stinger 121 also preferably releasably latches to packer 109. Lower valve 115 may then be opened. As in the case with upper valve 123, lower valve 115 may be of several types. Lower valve 115 could be actuated electrically or hydraulically by applying hydraulic fluid pressure through an annulus located within coiled tubing 128 surrounding the power cable. Lower valve 115 could be opened by pump pressure.

Figure 12:
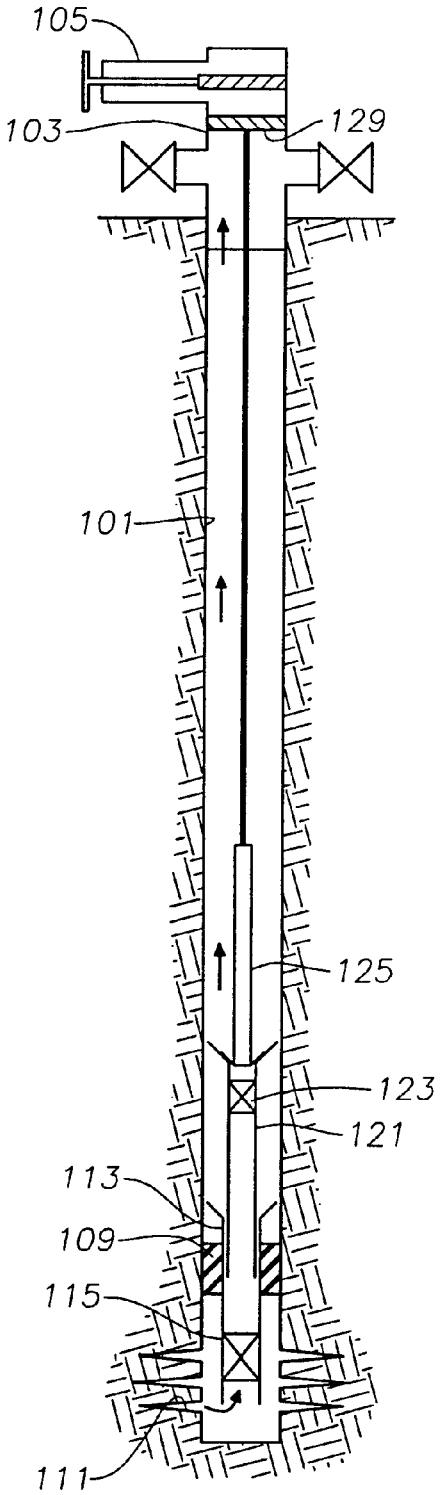
FIG. 12 is another schematic view of the well of FIG. 7, showing a final step.

Before opening, however, the upper end of coiled tubing 128 is prepared for production mode by cutting it and securing it to a coiled tubing hanger 129 as shown in FIG. 12. Access valve 105 may then be closed. As shown by the arrows in FIG. 12, production fluid flows through the bore of packer 109 to the intake of the pump of ESP assembly 125. ESP assembly 125 discharges the well fluid into casing 101 where proceeds to the surface.

ESP assembly 125 may be retrieved to the surface for repair or replacement by reversing the above-described procedure. Preferably, the lower valve 115 may be closed remotely, such as by hydraulic fluid pressure. Then, axial access valve 105 is opened and hanger 129 is removed. A coiled tubing unit will engage the upper end of coiled tubing 128, and pull ESP assembly 125 and upper packer 117 upward as a unit. When ESP 125 nears wellhead 103, the operator resets packer 117 in casing 101 and closes upper valve 123. The operator then unlatches ESP assembly 125 from upper packer 117 and retrieves it to the surface, as indicated in FIG. 9. Valves 115 and 123 provide two barriers that enable ESP assembly 125 to be safely removed from the well.

Figure 13:
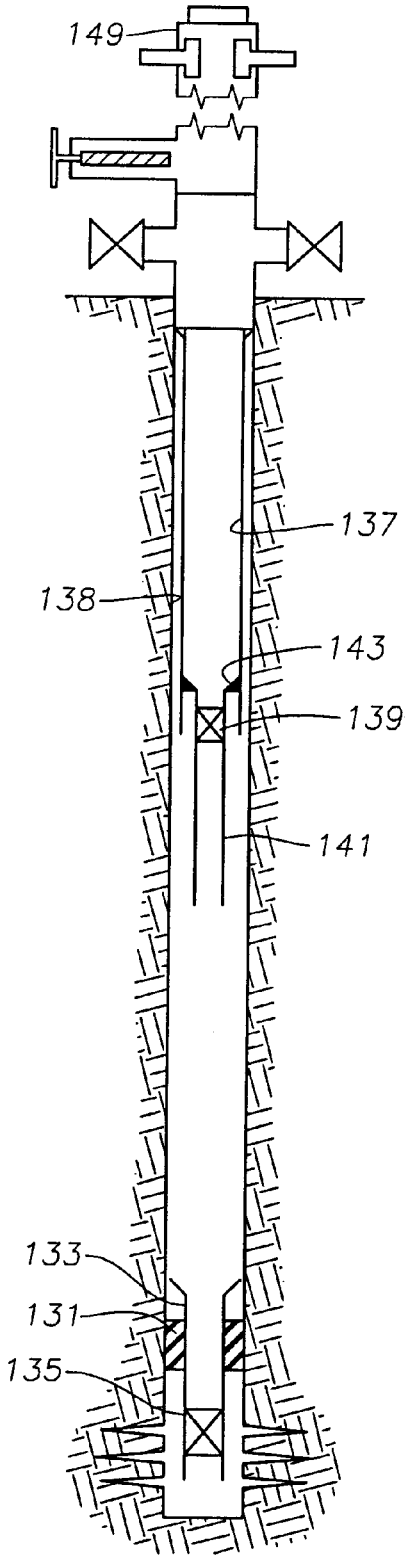
FIG. 13 is a schematic view of a well illustrating a variation of the embodiment of FIGS. 7–12.
Figure 14:
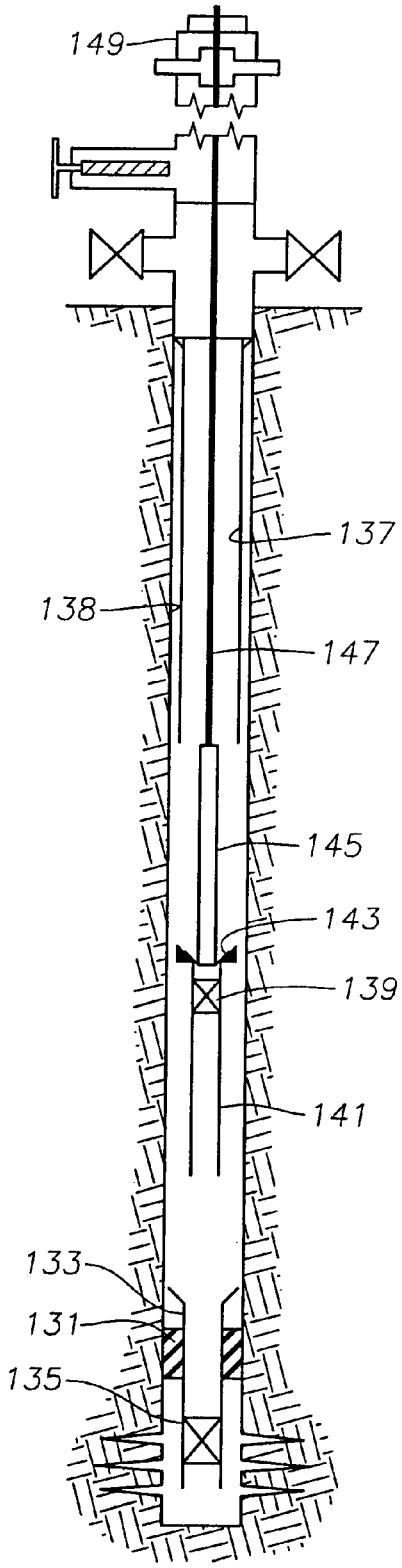
FIG. 14 is a sectional schematic view of the well of FIG. 13, showing another step.

FIGS. 13 and 14 illustrate a variation of the embodiment of FIGS. 8–12. Lower packer 131 is the same as lower packer 109, having a bore 133 and a lower safety valve 135. In this embodiment, however, a liner 137 is lowered in casing 138. Liner 137 has a mechanism mounted to it that includes an upper valve 139 located within a stinger 141. A latch 143 releasably latches and seals stinger 141 to liner 137 near the lower end of liner 137. Stinger 141 is a polished bore receptacle designed to receive ESP assembly 145. In the same manner as in embodiment of FIGS. 7–12, ESP assembly 145 is lowered on coiled tubing 147 and latched into stinger 141. Manipulating coiled tubing 147 causes latch 143 to release, enabling stinger 141, valve 139 and ESP assembly 145 to be lowered as a unit as shown in FIG. 14. Lubricator 149 seals against coiled tubing 147 to provide an upper pressure barrier. The lower pressure barrier is still handled by valve 135. Upper valve 139 is opened either before or after stinger 141 latches into bore 133 of lower packer 131.

Liner 137 needs to be only long enough to accommodate the length of ESP assembly 145. Latch 143 releasably locks as well as seals to liner 137. The operation of the embodiments of FIGS. 13–14 is substantially the same as the embodiment of FIGS. 7–12. Rather than setting an upper packer, however, liner 137 is deployed with valve 139 and stinger 141 releasably secured therein. The retrieval of ESP 145 for service or maintenance operates in reverse to the sequence described above. The operator pulls stinger 141 and valve 139 upward as a unit into latching engagement with liner 137. Then, after valve 139 is closed, ESP assembly 145 is retrieved to the surface.

Figure 15A:
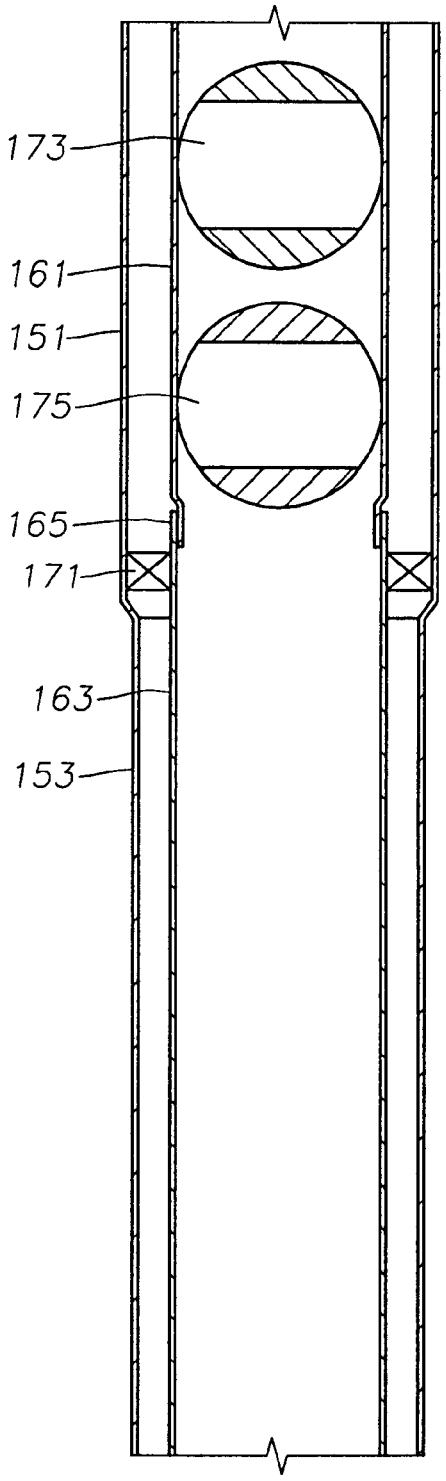
FIGS. 15A and 15B comprise a sectional schematic view of a well illustrating another embodiment of the invention.
Figure 15B:
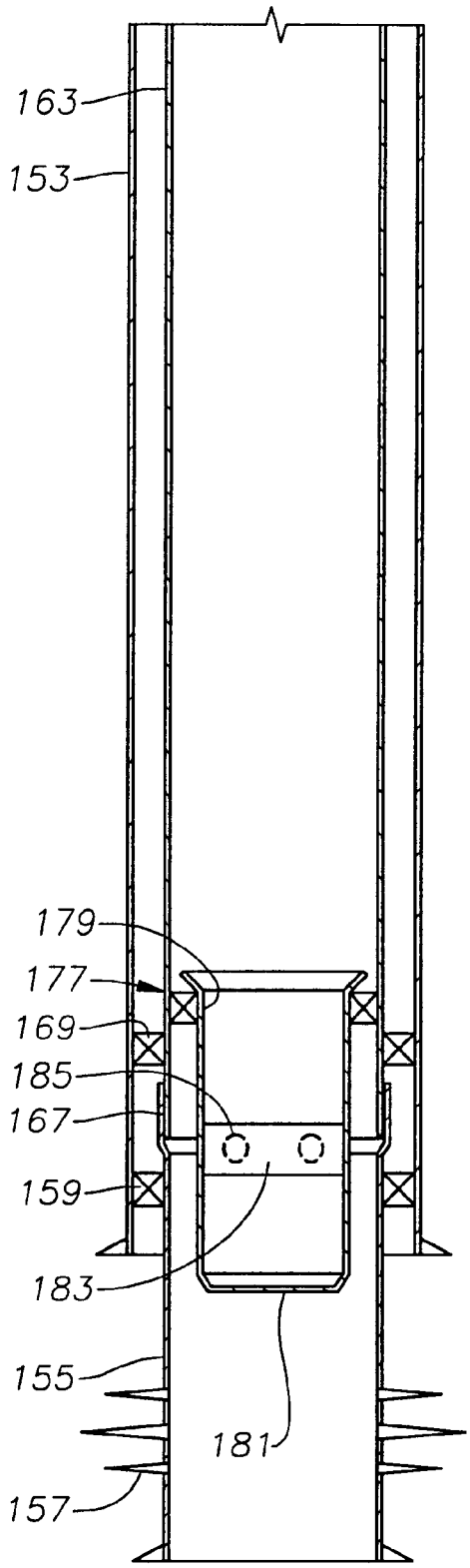

Referring to FIGS. 15A, 15B, another embodiment is shown. Although not essential, the well casing is shown with three different diameters. First there is an upper section 151 of larger diameter, a lower section 153 of an intermediate diameter and a lower extension 155, the smallest diameter. Lower extension 155 has perforations 157. In the embodiment shown, it is secured to the inner diameter of lower section 153 by a packer 159. The outer casing could be of a single diameter, if desired.

A flow conduit or liner is installed within casing sections 151, 153. The liner includes an upper section 161 of relatively short length. It is secured to a lower section 163 by a conventional tieback connection 165. Tieback connection 165 enables the upper liner section 161 to be disengaged from lower liner section 163 and retrieved to the surface. Preferably, upper section 161 is sufficiently short so that it can be pulled without a workover rig. The lower end of lower liner section 163 connects by another conventional tieback connection 167 to lower extension 155. In this embodiment, the diameters of sections 161 and 163 are the same as the diameter of lower extension 155. Lower liner section 163 is supported by a lower packer 169 and a hanger 171. Hanger 171 does not form a seal in the annulus between lower liner section 163 and casing 151. Lower packer 169 extends between the lower end of lower liner section 163 and lower casing section 153. Upper packer 171 extends between the upper end of the lower liner section 163 and upper casing section 151.

Figure 16A:
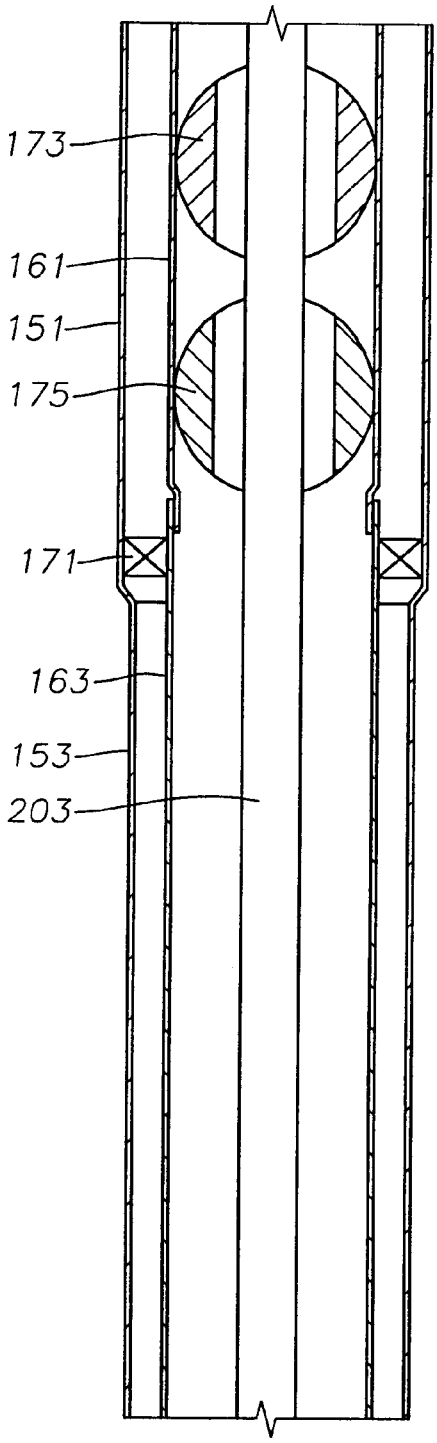
FIGS. 16A and 16B are sectional views of the well of FIGS. 15*a* and 15B, but showing an ESP installed.

A pair of deployment valves 173, 175 are installed in upper liner section 161 at the surface and lowered with liner 161. Valves 173, 175 are conventional. Although illustrated schematically as ball valves, because of the space restriction in upper casing string 151, they will preferably be curved flapper-type valves. Valves 173, 175 will be hydraulically actuated by a hydraulic line (not shown) that extends to the surface. Valves 173, 175 are shown in a closed position in FIG. 15A and an open position in FIG. 16A. Upper valve 173 is located at a depth slightly greater than the total length of an ESP assembly.

Referring to FIG. 15B, a packer 177 is set within lower liner section 163 near the lower end. Preferably, lower liner section 163 is deployed initially, then packer 177 is set on coiled tubing. After packer 177 is set, upper liner section 161 is lowered in place and tied back with tieback connection 165. Upper and lower liner sections 161, 163 alternately could be run together. Packer 177 has a bore 179 with a closed lower end 181. A sliding sleeve 183 engages bore 179. Sliding sleeve 183 opens and closes ports 185, with FIG. 15B showing the closed position and FIG. 16B, the open position. Other types of valves rather than sliding sleeve 183 may be employed as described in connection with the other embodiments.

Figure 16B:
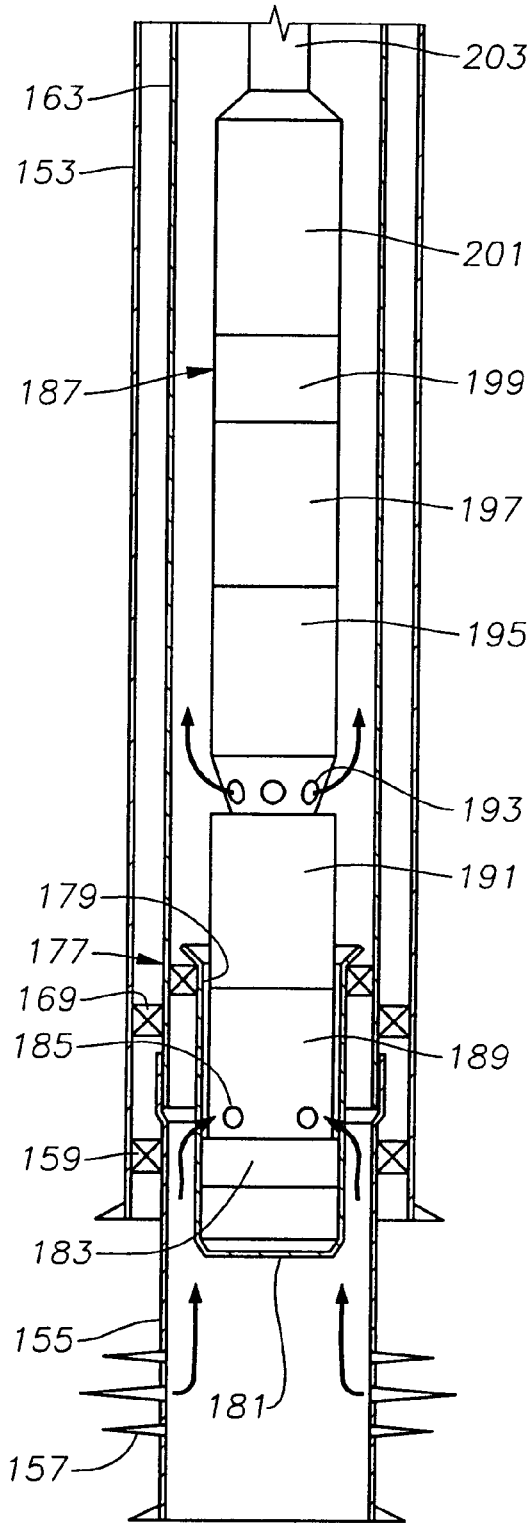

ESP assembly 187 is conventional and has a stinger 189 on its lower end as shown in FIG. 16B. ESP assembly 187 includes a pump 191 that has an upper discharge 193. A seal section 195 is preferably located on the upper end of pump 191. An electric motor 197, which could also be hydraulic, mounts on top of seal section 195. Other conventional components in the assembly include a coiled tubing disconnect 199 that allows disconnection in the event of an emergency. A coiled tubing adapter 201 connects the assembly to a string of coiled tubing 203.

In the operation of the embodiments of FIGS. 15A, 15B and 16A, 16B, lower liner section 163 is lowered into the well and connected by tieback connection 167 to lower extension 155 as shown in FIG. 15B. Lower extension 155 may have already been perforated. Packer 177 may be set using coiled tubing, also employing a lubricator as previously discussed. Upper liner section 161 may be deployed and connected to lower liner section 163 with lower tieback connection 167. A lubricator may also be used during this installation. Preferably, upper liner section 161 is lowered on coiled tubing.

Then, valves 173, 175 are closed. Valve 175 serves as an upper barrier while sliding sleeve 183 serves as a lower barrier. ESP assembly 187 is lowered into upper liner section 161 until it is fully within liner section 161. The lubricator at the surface will sealingly engage coiled tubing 203, and ball valves 173, 175 may then be moved to the open position shown in FIG. 16A. ESP assembly 187 is lowered through valves 173, 175. Stinger 189 engages receptacle 179. At the same time, stinger 189 will slide sliding sleeve 183 to an open position, exposing ports 185 as shown in FIG. 16B. The upper end of coiled tubing 203 will be cut and supported by the coiled tubing hanger as previously described. Production will flow up the flow conduit provided by liner sections 163, 161.

In the event that maintenance is desired for ESP assembly 187, it may be retrieved by reversing the procedure described above. In the event that maintenance is required of valves 173, 175, the upper liner section 161 may be retrieved, leaving lower liner section 163 in place. A lubricator at the surface will sealingly engage liner 161 as it is being removed from casing 151.

The invention has significant advantages. The various embodiments describe manners in which an ESP may be installed within a live well utilizing two barriers at all necessary times. The downhole isolation chambers provide temporary barriers. In the first embodiment, the isolation chamber is at the surface, but the snubber assembly need not be a length greater than the ESP assembly.

While the invention has been shown in several of its form, it should be apparent to those skilled in the art that it is not so limited, but is susceptible to various changes without departing from the scope of the invention.

We claim:

1. A method for installing a submersible pump assembly in a well, comprising:

(a) installing a pressure barrier in the well at a depth lower than a length of the submersible pump assembly, defining a chamber in the well isolated from any pressure in the well below;

(b) lowering the submersible pump assembly on a line into the chamber; then (c) sealing around the line, releasing the pressure barrier, and lowering the submersible pump assembly into the well to a desired depth; wherein:

step (a) is performed by lowering the pressure barrier in a collapsed configuration, then expanding the pressure barrier; and the pressure barrier is released by collapsing the pressure barrier and withdrawing the pressure barrier along a path laterally of the submersible pump assembly.

2. A method for installing a submersible pump assembly in a well, comprising:

(a) installing a pressure barrier in the well at a depth lower than a length of the submersible pump assembly, defining a chamber in the well isolated from any pressure in the well below;

(b) lowering the submersible pump assembly on a line into the chamber; then (c) sealing around the line, releasing the pressure barrier, and lowering the submersible pump assembly into the well to a desired depth; wherein the well has a casing, and:

step (a) is performed by installing a flow conduit in the well that defines an annulus within the casing, then lowering the pressure barrier in a collapsed configuration through the annulus, then expanding the pressure barrier in the casing below the flow conduit;

step (b) is performed by lowering the submersible pump assembly into the flow conduit; and the pressure barrier is released by collapsing the pressure barrier and withdrawing the pressure barrier back into the annulus.

3. A method for installing a submersible pump assembly in a well, comprising:

(a) installing a pressure barrier in the well at a depth lower than a length of the submersible pump assembly, defining a chamber in the well isolated from any pressure in the well below;

(b) lowering the submersible pump assembly on a line into the chamber; then (c) sealing around the line, releasing the pressure barrier, and lowering the submersible pump assembly into the well to a desired depth; wherein:

step (a) is performed by lowering the barrier in a collapsed configuration through a tubing located off center in the well, then expanding the pressure barrier in the well below the tubing;

step (b) is performed by lowering the submersible pump assembly into the well alongside the tubing; and the pressure barrier is released by collapsing the pressure barrier and withdrawing the pressure barrier up into the tubing.

4. A method for installing a submersible pump assembly in a well, comprising:

(a) installing a pressure barrier in the well at a depth lower than a length of the submersible pump assembly, defining a chamber in the well isolated from any pressure in the well below;

(b) lowering the submersible pump assembly on a line into the chamber; then (c) sealing around the line, releasing the pressure barrier, and lowering the submersible pump assembly into the well to a desired depth; wherein the well contains a casing and wherein the method further comprises:

installing a flow conduit extending into the casing to a selected depth;

installing a tubing in the flow conduit offset from an axis of the flow conduit; and wherein the temporary pressure barrier is installed by lowering the pressure barrier in a collapsed configuration through the tubing, then expanding the pressure barrier within the flow conduit below the tubing;

the submersible pump assembly is lowered into the flow conduit alongside the tubing; and the pressure barrier is removed by collapsing the pressure barrier and withdrawing the pressure barrier up into the tubing.

5. A method for installing a submersible pump assembly in a well, comprising:

(a) installing a pressure barrier in the well at a depth lower than a length of the submersible pump assembly, defining a chamber in the well isolated from any pressure in the well below;

(b) lowering the submersible pump assembly on a line into the chamber; then (c) sealing around the line, releasing the pressure barrier, and lowering the submersible pump assembly into the well to a desired depth; wherein installing the pressure barrier is performed by lowering the pressure barrier on a first string of coiled tubing; and step (b) is performed by lowering the submersible pump assembly on a second string of coiled tubing.

6. A method for installing a submersible pump assembly in a well, comprising:

(a) installing a pressure barrier in the well at a depth lower than a length of the submersible pump assembly, defining a chamber in the well isolated from any pressure in the well below;

(b) lowering the submersible pump assembly on a line into the chamber; then (c) sealing around the line, releasing the pressure barrier, and lowering the submersible pump assembly into the well to a desired depth; wherein step (a) comprises:

installing a packer in the well, the packer having a throughbore containing a valve and having an open upper end; step (b) comprises:

while the valve is closed, lowering the submersible pump assembly and latching the submersible pump assembly into the throughbore of the packer; and step (c) comprises:

releasing the packer and lowering the packer and the submersible pump assembly together as a unit to the desired depth; and before installing the first-mentioned packer in the well, installing a lower packer in the casing, the lower packer having a bore containing a lower valve and having an open upper end; and step (c) further comprises landing a lower portion of the unit in the bore of the lower packer and opening the lower valve to communicate well fluid to the submersible pump assembly.

7. A method for installing a submersible pump assembly in a well, comprising:

(a) installing a pressure barrier in the well at a depth lower than a length of the submersible pump assembly, defining a chamber in the well isolated from any pressure in the well below;

(b) lowering the submersible pump assembly on a line into the chamber; then (c) sealing around the line, releasing the pressure barrier, and lowering the submersible pump assembly into the well to a desired depth; wherein step (a) comprises:

installing a flow conduit in the well, the flow conduit having at least one upper valve that blocks flow through the flow conduit, the upper valve being located a distance below the upper end of the well that is greater than a length of the submersible pump assembly, and setting a packer in the flow conduit, the packer having a bore with a lower valve therein and an open upper end; step (b) comprises lowering the submersible pump assembly into the flow conduit on a line while both of the valves are closed; and step (c) comprises while sealing on the line, opening the upper valve, and continuing to lower the submersible pump assembly while maintaining a seal on the line, then landing a lower portion of the submersible pump assembly in the bore of the packer and opening the lower valve to communicate formation fluid to the submersible pump assembly.

8. A method for installing a submersible pump assembly in a well, comprising:

(a) on a first line, lowering a pressure barrier into the well in a collapsed configuration to a depth lower than a length of the submersible pump assembly, then expanding the pressure barrier to a set position, defining a chamber in the well isolated from any pressure in the well below;

(b) on a second line, lowering the submersible pump assembly into the chamber; then (c) sealing around the second line, collapsing the pressure barrier and withdrawing the pressure barrier with the first line along a path lateral of the submersible pump assembly; then (d) with the second line, lowering the submersible pump assembly into the well to a desired depth.

9. The method according to claim 8, wherein the second line comprises coiled tubing, and while performing step (d) a seal is maintained on the coiled tubing at the top of the well.

10. The method according to claim 8, wherein step (a) further comprises: installing a tubing in the well laterally offset from an axis of the well, and lowering the pressure barrier through the tubing.

11. The method according to claim 8, further comprising:

before step (a), setting a packer in the well that has a throughbore and a valve in the throughbore that is closed to provide a first barrier against pressure in the well, and in step (a) the pressure barrier is installed above the packer; and in step (d), a lower portion of the submersible pump assembly is landed in the packer.

12. A method for installing a submersible pump assembly in a well having a casing, the method comprising:

(a) installing a packer in the casing, the packer having a throughbore containing a valve and having an open upper end;

(b) while the valve is closed, lowering the submersible pump assembly into the casing, and latching the submersible pump assembly into the throughbore of the packer; then (c) releasing the packer and lowering the packer and the submersible pump assembly together as a unit to a desired depth; and before step (a), installing a lower packer in the casing, the lower packer having a bore containing a lower valve and having an open upper end; and step (c) further comprises:

landing a lower portion of the unit in the bore of the lower packer and opening the lower valve to communicate well fluid to the submersible pump assembly.

13. A method for installing a submersible pump assembly in a well having a casing, the method comprising:

(a) installing a packer in the casing, the packer having a throughbore containing a valve and having an open upper end;

(b) while the valve is closed, lowering the submersible pump assembly on a line into the casing, and latching the submersible pump assembly into the throughbore of the packer; then (c) releasing the packer and lowering the packer and the submersible pump assembly together as a unit to a desired depth;

providing a pressure controller at the surface of the well that will seal on the line while the line is moved; and prior to step (c), closing the pressure controller around the line, then performing step (c) with the pressure controller sealing around the line.

14. A method for installing a submersible pump assembly in a live well having a casing that may be under pressure, the method comprising:

(a) installing a pressure controller at a top of the well;

(b) installing a lower packer in the casing, the lower packer having a throughbore containing a lower valve and having an open upper end;

(c) setting an upper packer in the well above the lower packer while the lower valve is closed, the upper packer having a bore containing an upper valve and having an open upper end;

(d) lowering the submersible pump assembly on a string of coiled tubing into the casing while the valves are closed, and latching the submersible pump assembly into the bore of the upper packer;

(e) releasing the upper packer and lowering the upper packer and the submersible pump assembly together as a unit on the coiled tubing while the pressure controller sealingly engages the coiled tubing; and (f) landing a lower portion of the unit in the bore of the lower packer and opening the lower valve, communicating well fluid to the submersible pump assembly.

15. The method according to claim 14, wherein step (c) further comprises:

providing the upper packer with a depending stinger; and step (f) comprises inserting the stinger sealingly into the bore of the lower packer.

16. The method according to claim 14, wherein step (d) further comprises:

providing the coiled tubing with an internal actuator link; and step (f) further comprises:

operatively engaging the actuator link with the lower valve and opening the valve by communicating from the surface to the lower valve via the actuator link.

17. The method according to claim 14, wherein step (d) further comprises:

providing the coiled tubing with a hydraulic flowpath; and step (f) further comprises:

communicating the flowpath with the lower valve and opening the valve by supplying hydraulic pressure from the surface through the flowpath.

18. The method according to claim 14, wherein step (c) comprises sealingly engaging the casing with the upper packer.

19. The method according to claim 14, further comprising:

installing a flow conduit in the casing before performing step (c); and wherein step (c) comprises:

installing the upper packer in the flow conduit.

20. The method according to claim 14, further comprising retrieving the submersible pump assembly after step (f) by the following steps:

closing the lower valve; then pulling the submersible pump assembly and the upper packer upward from the bore of the lower packer; then resetting the upper packer in the well a selected distance above the lower packer; then with the upper valve closed, pulling the submersible pump assembly upward from the upper packer to the surface.

21. A method for installing a submersible pump assembly in a well having a casing, the method comprising:

(a) installing a flow conduit extending downward from an upper end of the well within the casing, the flow conduit having at least one upper valve that blocks flow through the flow conduit, the upper valve being located a distance below the upper end of the well that is greater than a length of the submersible pump assembly;

(b) setting a packer in the flow conduit, the packer having a bore with a lower valve therein and an open upper end;

(c) lowering the submersible pump assembly into the flow conduit on a line while both of the valves are closed; then (d) while sealing on the line, opening the upper valve, and continuing to lower the submersible pump assembly while maintaining a seal on the line; then (f) landing a lower portion of the submersible pump assembly in the bore of the packer and opening the lower valve to communicate formation fluid to the submersible pump assembly.

22. The method according to claim 22, wherein opening the lower valve comprises sliding a sleeve.

23. The method according to claim 21, wherein step (a) further comprises installing a lower extension of the flow conduit below the casing; and the method further comprises perforating the lower extension.

24. The method according to 23, wherein the lower extension is installed before running the flow conduit, and the flow conduit lands and ties back to the lower extension.

25. The method according to 21, wherein the line comprises coiled tubing.

26. A method for installing a submersible pump assembly in a well having a casing and performing certain maintenance operations, the method comprising:

(a) installing a flow conduit extending downward from an upper end of the well within the casing, the flow conduit having an upper section and a lower section, the upper section being retrievable relative to the lower section, the upper section of the flow conduit having at least one upper valve that when closed blocks flow through the flow conduit, the upper valve being located a distance below the upper end of the well that is greater than a length of the submersible pump assembly;

(b) setting a packer in the lower section of the flow conduit, the packer having a throughbore with a lower valve therein and an open upper end;

(c) lowering the submersible pump assembly on a line into the flow conduit while both of the valves are closed; then (d) while sealing on the line, opening the upper valve, and lowering the submersible pump assembly through the upper valve; then (e) landing a lower portion of the submersible pump assembly in the throughbore of the packer and opening the lower valve to communicate formation fluid to the submersible pump assembly; then, to service or replace the upper valve, (f) closing the lower valve and with the line pulling the submersible pump assembly upward above the upper valve while sealingly engaging the line; then (g) closing the upper valve, and retrieving the submersible pump assembly to the surface; then (h) retrieving the upper section of the flow conduit along with the upper valve while leaving the lower section installed in the well; then (i) after repairing or replacing the upper valve, lowering the upper section of the flow conduit back into the well and tying back the upper section of the flow conduit to the lower section of the flow conduit; then (j) reinstalling the submersible pump assembly in the packer by repeating steps (c), (d) and (e).

27. The method according to 26, wherein while retrieving the upper section of the flow conduit during step (h), a pressure controller at the upper end of the well sealingly engages the upper section of the flow conduit.

28. The method according to 26, wherein step (a) comprises supporting an upper end of the lower section of the flow conduit with a packer that grips the casing.

29. The method according to 26, wherein the flow conduit is installed in step (a) by first lowering the lower section of the flow conduit and tying the lower section of the flow conduit back to the casing; then lowering the upper section of the flow conduit and stabbing a lower end of the upper section of the flow conduit into operative engagement with an upper end of the lower section of the flow conduit.

30. A method for installing a submersible pump assembly in a well, the submersible pump assembly having at least two components separated by a connection, the components including a prime mover and a pump, each of the components having a substantially cylindrical housing, the pump having a flowpath from an intake to an outlet, the method comprising:

(a) providing upper and lower seals that will seal on the components while simultaneously allowing downward sliding movement of the components;

(b) connecting a tubular chamber between the seals to provide a pressure control assembly, the chamber having a length less than an overall length of the submersible pump assembly;

(c) closing an access valve to block axial access to the well, then mounting the pressure control assembly to a wellhead;

(d) installing a valve in the submersible pump assembly and closing the valve to prevent flow through the flowpath of the pump;

(e) opening the access valve and lowering the submersible pump assembly through the upper and lower seals of the pressure control assembly; then (f) when at a desired depth, opening the valve in the submersible pump assembly.

31. The method according to claim 30, wherein the length of the chamber being selected so that when the connection is adjacent the lower seal, the upper seal will be in sealing engagement with one of the components.

32. The method according to claim 30, wherein the upper and lower seals are movable between open and closed positions, and wherein the method further comprises:

closing the lower seal around one of the components when the connection is adjacent the upper seal and opening the upper seal; and opening the lower seal when the connection is adjacent the lower seal and closing the upper seal around one of the components.

33. The method according to claim 30, wherein a portion of the submersible pump assembly protrudes above the upper seal while the lower seal first begins to engage one of the components.

34. The method according to claim 30, wherein the submersible pump assembly is lowered on coiled tubing, the method further comprising:

sealing on the coiled tubing as the coiled tubing is lowered through the pressure control assembly.

35. The method according to claim 30, wherein the connection causes a discontinuity in the submersible pump assembly that prevents effective sealing engagement by the upper and lower seals as the connection passes through the upper and lower seals.

36. The method according to claim 30, wherein the submersible pump assembly is lowered into the well by gripping a portion of the submersible pump assembly with a gripper assembly mounted to the pressure control assembly and moving the submersible pump assembly downward.

37. A method for installing a submersible pump assembly in a live well that may contain pressure, the submersible pump assembly having at least an upper and a lower component separated by a connection, the components including a prime mover and a pump, each of the components having a substantially cylindrical housing that differs in diameter from a cross-sectional dimension of the connection, the pump having a flowpath from an intake to an outlet, the method comprising:

(a) providing upper and lower seals that have closed positions that seal on the components while simultaneously allowing downward sliding movement of the components;

(b) connecting a tubular chamber between the seals to provide a pressure control assembly, the chamber having a length less than an overall length of the submersible pump assembly;

(c) closing an access valve to block axial access to the well, then mounting the pressure control assembly to a wellhead and a gripper assembly to an upper end of the pressure control assembly;

(d) installing a valve in the submersible pump assembly and closing the valve to prevent flow through the flowpath of the pump;

(e) securing a head of the submersible pump assembly to a string of coiled tubing;

(f) gripping the submersible pump assembly with the gripper assembly and moving the submersible pump assembly through the upper seal and into the chamber;

(g) closing the lower seal against the lower component and opening the access valve;

(h) closing the upper seal against the upper component and continuing to move the submersible pump assembly downward with the gripper assembly;

(i) when the connection nears the lower seal, opening the lower seal while continuing to seal the upper component with the upper seal, then closing the lower seal against the upper component after the connection passes;

(j) when the head nears the upper seal, opening the upper seal while continuing to seal against the lower component with the lower seal; then (k) sealing against the coiled tubing as the submersible pump moves downward in the well.

38. The method according to claim 37, wherein step (k) is performed by mounting a coiled tubing lubricator to the pressure control assembly after the head passes below the upper seal and sealingly engaging the coiled tubing with the lubricator.

39. A method for installing a submersible pump assembly in a well, comprising:

(a) on a first line, lowering a pressure barrier into the well in a collapsed configuration to a depth lower than a length of the submersible pump assembly, then expanding the pressure barrier to a set position, defining a chamber in the well isolated from any pressure in the well below;

(b) on a second line, lowering the submersible pump assembly into the chamber; then (c) sealing around the second line, collapsing the pressure barrier and moving the pressure barrier with the first line along a path lateral of the submersible pump assembly to a point where the pressure barrier will not obstruct downward movement of the submersible pump assembly; then (d) with the second line, lowering the submersible pump assembly into the well to a desired depth.

40. A method for installing a submersible pump assembly in a well, the method comprising:

(a) installing a lower valve in the well;

(b) installing a pressure barrier in the well above the lower valve while the lower valve is closed, the pressure barrier having a throughbore containing an upper valve and having an open upper end;

(c) while the upper and lower valves are closed, lowering the submersible pump assembly into the well, and latching the submersible pump assembly into the throughbore of the pressure barrier; then (d) releasing the pressure barrier, opening the upper valve and lowering the pressure barrier and the submersible pump assembly together as a unit to a desired depth in the well; then (e) opening the lower valve.

41. A method for installing a submersible pump assembly in a well, the method comprising:

(a) installing a pressure barrier in the well, the pressure barrier having a throughbore containing a valve and having an open upper end;

(b) while the valve is closed, lowering the submersible pump assembly on a line into the well, and latching the submersible pump assembly into the throughbore of the pressure barrier;

(c) sealing around the line with a pressure controller at the surface of the well; then (d) releasing the pressure barrier, opening the valve and lowering the pressure barrier and the submersible pump assembly together as a unit to a desired depth in the well while continuing to seal around the line with the pressure controller.

42. A method for installing a submersible pump assembly in a well, the method comprising:

(a) installing a lower valve in the well;

(b) installing a pressure barrier in the well above the lower valve while the lower valve is closed, the pressure barrier having a throughbore containing an upper valve and having an open upper end;

(c) while the upper and lower valves are closed, lowering the submersible pump assembly on a line into the well, and latching the submersible pump assembly into the throughbore of the pressure barrier;

(d) sealing around the line with a pressure controller at the surface of the well; then (e) releasing the pressure barrier, opening the upper valve and lowering the pressure barrier and the submersible pump assembly together as a unit to a desired depth in the well while continuing to seal around the line with the pressure controller; then (f) opening the lower valve.

43. A method for installing a submersible pump assembly in a well having a casing, the method comprising:

(a) installing a lower valve in the well;

(b) installing a flow conduit extending downward from an upper end of the well within the casing, the flow conduit having at least one upper valve above the lower valve that blocks flow through the flow conduit, the upper valve being located a distance below the upper end of the well that is greater than a length of the submersible pump assembly;

(c) lowering the submersible pump assembly into the flow conduit on a line while both of the valves are closed; then (d) while sealing on the line, opening the upper valve, and continuing to lower the submersible pump assembly while maintaining a seal on the line; then (e) landing the submersible pump assembly at a desired depth and opening the lower valve to communicate formation fluid to the submersible pump assembly.

44. A method for installing a submersible pump assembly in a well having a casing and performing certain maintenance operations, the method comprising:

(a) installing a flow conduit extending downward from an upper end of the well within the casing, the flow conduit having an upper section and a lower section, the upper section being retrievable relative to the lower section, the upper section of the flow conduit having at least one upper valve that when closed blocks flow through the flow conduit, the upper valve being located a distance below the upper end of the well that is greater than a length of the submersible pump assembly;

(b) installing a lower valve in the lower section of the flow conduit;

(c) lowering the submersible pump assembly on a line into the flow conduit while both of the valves are closed; then (d) while sealing on the line, opening the upper valve, and lowering the submersible pump assembly through the upper valve; then (e) landing the submersible pump assembly and opening the lower valve to communicate formation fluid to the submersible pump assembly; then, to service or replace the upper valve, (f) closing the lower valve and with the line pulling the submersible pump assembly upward above the upper valve while sealingly engaging the line; then (g) closing the upper valve, and retrieving the submersible pump assembly to the surface; then (h) retrieving the upper section of the flow conduit along with the upper valve while leaving the lower section installed in the well; then (i) after repairing or replacing the upper valve, lowering the upper section of the flow conduit back into the well and tying back the upper section of the flow conduit to the lower section of the flow conduit; then (j) reinstalling the submersible pump assembly in the well by repeating steps (c), (d) and (e).

45. A method for installing a submersible pump assembly in a well, the method comprising:

(a) installing a lower pressure barrier in the well that has an open and a closed position;

(b) installing an upper pressure barrier in the well above the lower pressure barrier while the lower pressure barrier is in the closed position; then (c) lowering the submersible pump assembly on a line into the well, with the upper and lower pressure barriers sealing against any pressure in the well;

(d) sealing around the line with a pressure controller at the surface of the well, then releasing the upper pressure barrier from sealing against any pressure in the well, and lowering the submersible pump assembly to a desired depth in the well while the lower pressure barrier is still in the closed position; then (e) moving the lower pressure barrier to the open position.

* * * * *

UNITED STATES PATENT AND TRADEMARK OFFICE

CERTIFICATE OF CORRECTION

PATENT NO. : 6,328,111 B1
DATED : December 11, 2001
INVENTOR(S) : John Bearden et al.

It is certified that error appears in the above-identified patent and that said Letters Patent is hereby corrected as shown below:

Column 6,
Lines 59-61, delete the sentence: "Additionally we need to show a ram type BOP, fitted with slips to grip an hold the ESP assembly, just blow BOP 23."

Signed and Sealed this

Second Day of July, 2002

*Attest:*

*Attesting Officer*

JAMES E. ROGAN
*Director of the United States Patent and Trademark Office*